US007344138B2

(12) United States Patent
Romney

(10) Patent No.: US 7,344,138 B2
(45) Date of Patent: Mar. 18, 2008

(54) POKER PAD

(76) Inventor: Scott Romney, 406 Appletree Ave., Camarillo, CA (US) 93012

( * ) Notice: Subject to any disclaimer, the term of this patent is extended or adjusted under 35 U.S.C. 154(b) by 0 days.

(21) Appl. No.: 11/177,744

(22) Filed: Jul. 8, 2005

(65) Prior Publication Data

US 2007/0007727 A1 Jan. 11, 2007

(51) Int. Cl.
*A63F 1/06* (2006.01)
*A63F 3/00* (2006.01)

(52) U.S. Cl. ..... 273/309; 273/274; 273/282.1; 273/287; 273/DIG. 4; 273/DIG. 5; 273/DIG. 12

(58) Field of Classification Search ..... 273/309, 273/274, 282.1, 282.2, 287, 2, DIG. 4, DIG. 5, 273/DIG. 12
See application file for complete search history.

(56) References Cited

U.S. PATENT DOCUMENTS 3,251,600 A * 5/1966 Warnberg ..... 273/282.1
D259,497 S * 6/1981 Mahler ..... D21/338
5,516,112 A 5/1996 Rypinski ..... 273/287
6,171,160 B1 * 1/2001 Skaggs et al. ..... 441/129
2004/0173123 A1 * 9/2004 Roig et al. ..... 108/25

OTHER PUBLICATIONS

Skydancers International: Swim Up Floating Card Gaming Table, www.swimupblackjack.com, Sep. 21, 2004.*

* cited by examiner

*Primary Examiner*—Benjamin Layno
(74) *Attorney, Agent, or Firm*—Philip T. Virga

(57) ABSTRACT

A floating poker pad is provided that may be used on both land and water. The poker pad has a base member that has an upper surface and a lower surface. The upper surface of the floating poker pad has a slightly slopped central inner playing area for poker or card play and defines one or more water drainage scuppers for keeping the central inner playing area free from water build-up. Additionally, the floating poker pad has upper openings for receiving beverages and poker playing chips and defines a central opening throughout the base member for receiving an umbrella pole when placed on a patio table for use as a poker table on land.

18 Claims, 5 Drawing Sheets

POKER PAD

FIELD OF THE INVENTION

The present invention relates to a poker pad. More particularly, the present invention relates to a floating poker pad having a central inner playing area for poker or card play in a Jacuzzi or pool and defines one or more water drainage scuppers for keeping the central inner playing area free from water build-up. Still more particularly, the present invention relates to a poker pad having upper openings for receiving beverages and poker playing chips and the like and defines a central opening for receiving an umbrella pole when placed on an outdoor patio table for use as a poker table on land.

BACKGROUND

Floating tables have been proposed for use in swimming pools, lakes, beaches, and the like, for recreational purposes. However, such tables would not be suitable for use on land. Such tables would have to be placed directly on the ground, and thus, discourages its use on land. Moreover, a patio table is commonly used with an umbrella, which, typically, is mounted on the table by attaching the post of the umbrella to an aperture or other opening centrally provided on the table. The presence of the post on the table provides an obstruction which may interfere with the central placement of a cloth or pad for use of the table as a game table. Thus, a need exists for a floating game table that may be used both in a water environment, and is easily adapted for use as a game table on land in association with a patio table.

SUMMARY

A floating poker pad is provided that may be used on both land and water. The poker pad has a floatable base member that has an upper surface and a lower surface. The upper surface of the floatable base member has a slightly slopped central inner playing area for poker or card play and defines one or more water drainage scuppers for keeping the central inner playing area free from water build-up. The central inner playing area also provides space for the removable installation of a carpet-type playing surface therein. Additionally, the floatable base member has upper openings for receiving beverages and poker playing chips and defines a central opening throughout the base member and carpet-type playing surface for receiving an umbrella pole when placed on a patio table for use as a poker table on land.

Other advantages and salient features of the invention will become apparent from the following detailed description, which, taken in conjunction with the annexed drawings, discloses a preferred embodiment of the invention.

BRIEF DESCRIPTION OF THE DRAWINGS

Referring now to the drawings that form a part of the original disclosure.

DETAILED DESCRIPTION OF THE DRAWINGS

Figure 1:
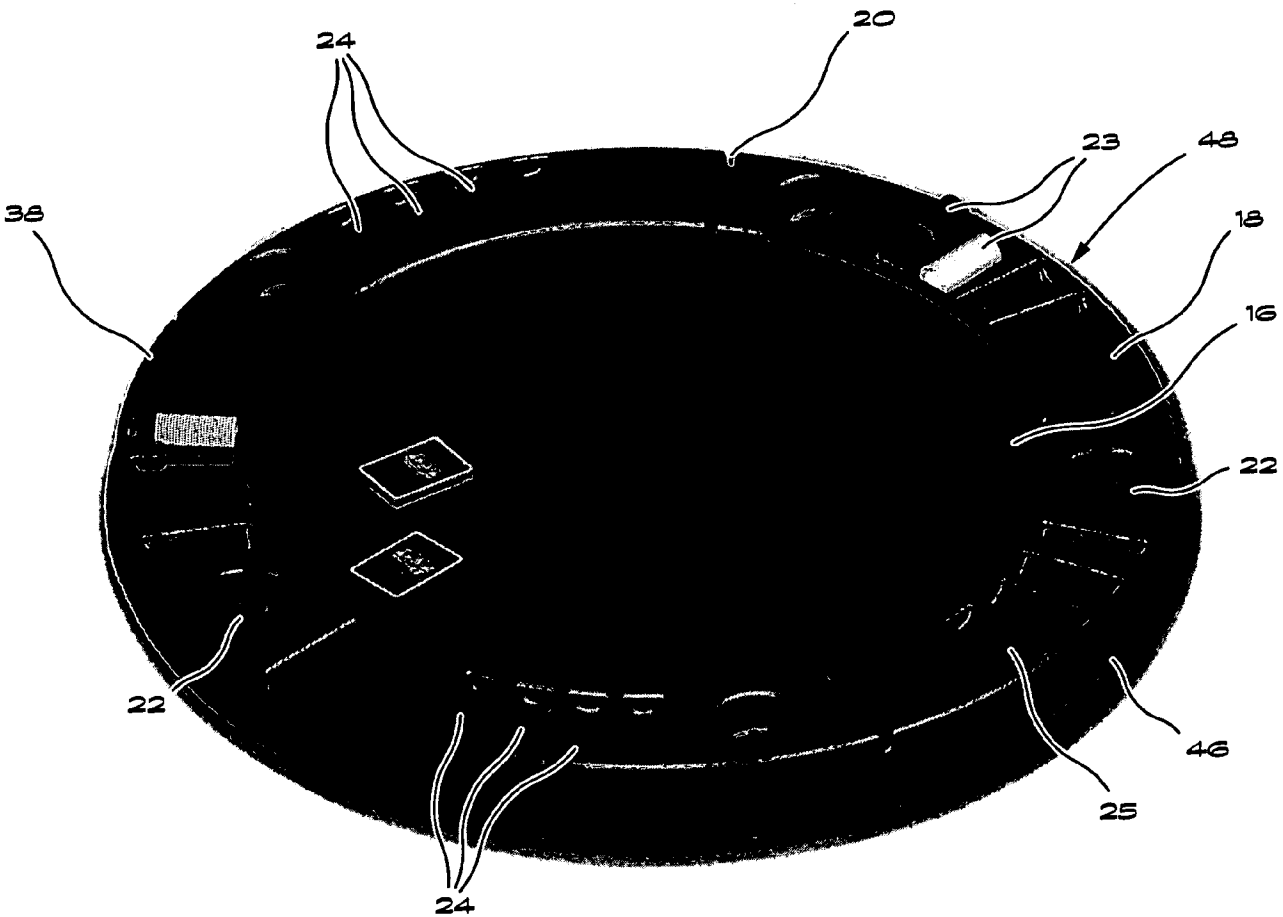
FIG. 1 is a perspective view of upper surface of the floating poker pad of the present invention.
Figure 2B:
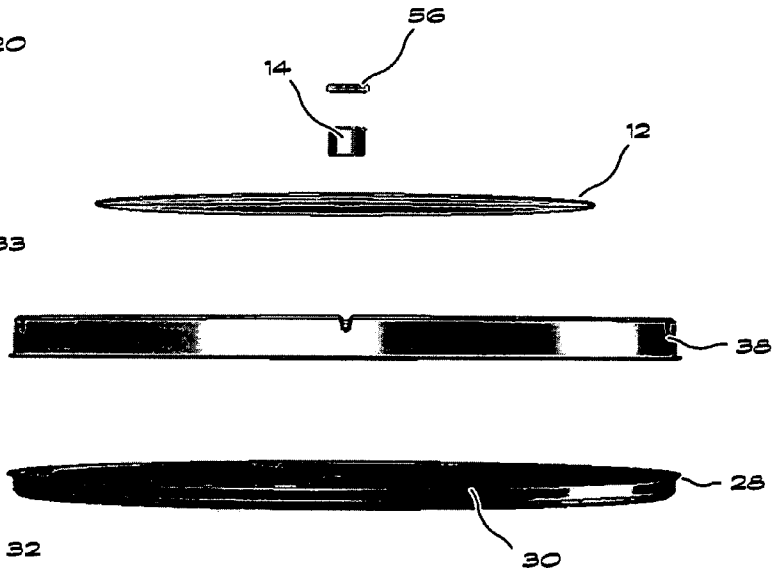
FIG. 2B is an exploded side elevational view of the floating poker pad of FIG. 1.
Figure 2A:
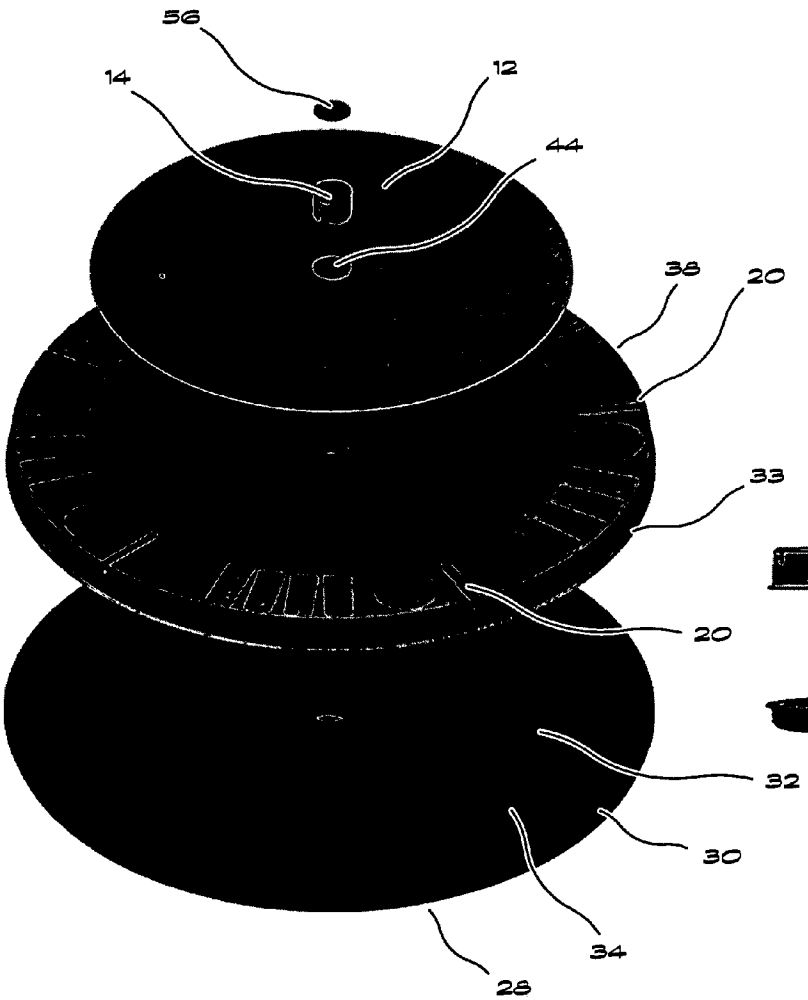
FIG. 2A is an exploded perspective view of the floating poker pad of FIG. 1.
Figure 4:
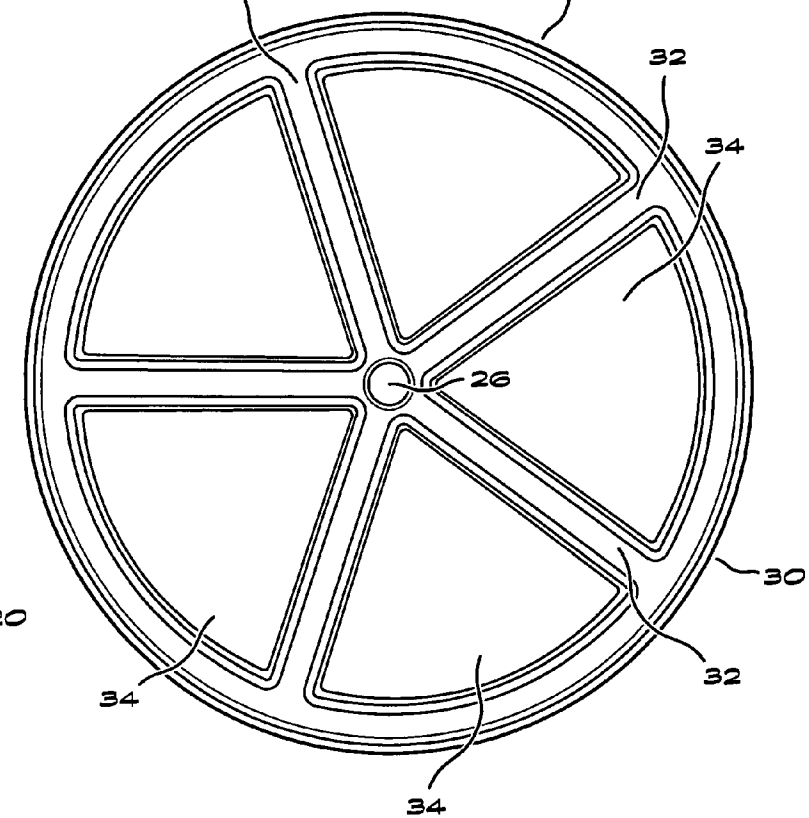
FIG. 4 is a plan view of the lower surface of the floating poker pad of FIG. 1 showing strength support ribs.
Figure 3:
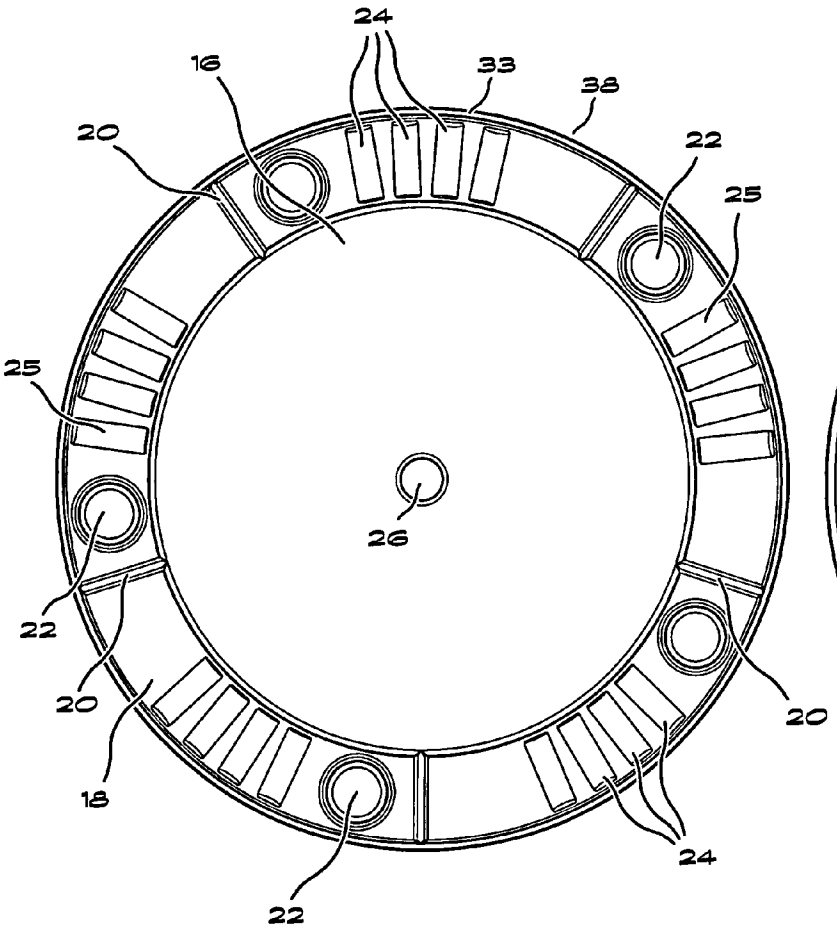
FIG. 3 is a plan view of the upper surface of the floating poker pad of FIG. 1 showing the upper openings and water drainage scuppers.

Referring to FIGS. 1-5 of the drawings, the present invention will be seen to relate to a poker pad 48 that may be used on both land and water. Referring now particularly to FIGS. 1, 3 and 4, the poker pad 48 comprises a floatable base member 46 that has an upper surface or top half 38 and a lower surface or bottom half 28. The upper surface 38 includes a circular, slightly sloped central inner playing area 16 surrounded by a relatively higher, raised circumferential outer playing area periphery 18. The central inner playing area 16 provides space for the removable installation of a carpet-type playing surface 12 therein as shown in FIG. 2B. Referring to FIGS. 2A and 2B the carpet-type playing surface 12 is circularly shaped and sized to be slightly smaller than the circumference of the central inner playing area 16 for the placement down and lifting off of the carpet-type playing surface 12 relative to the central inner playing area 16. Thus, various carpet-type playing surfaces 12 having different decorative logos and/or indicia (not shown) if desired, may be removably placed within the playing area periphery 16 for the play of a game.

The inner playing area 16 and outer playing area periphery 18 are in turn surrounded by a plurality of generally circumferential concave areas defined within the outer playing area periphery 18 and divided into a plurality (e.g., five) of semicircumferential chip rack areas 24 adapted for the edgewise storage of poker chips therein. The chip rack areas 24 are divided into a plurality (e.g., four) of adjacent individual chip storage areas 25 each having a generally semicircular cross section, to closely fit the circular shape of poker chips 23 which may be stored therein as shown in FIG. 1. Referring to FIG. 3, adjacent to each of these chip rack areas 24 in the outer playing area periphery 18 are a plurality of upper openings 22 defined by the upper surface 38 which are adapted to receive beverage containers. Therefore for each chip rack area 24 there is associated and paired next to it an upper opening 22 for receiving a beverage container. The upper openings 22 may be any shape, but are preferably circular.

Figure 5:
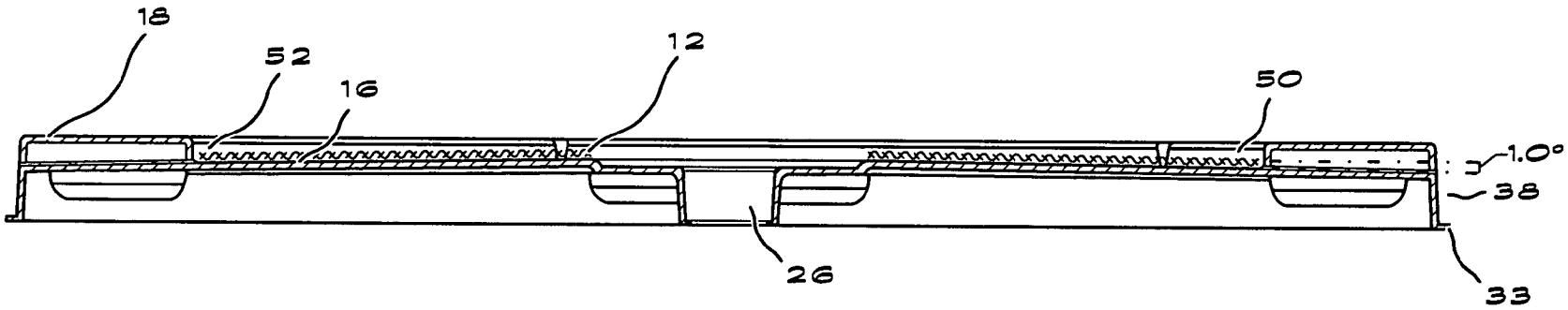
FIG. 5 is a side elevational view in cross-section of the upper surface illustrating a sloped surface used for water drainage.

Referring once again to FIG. 3, adjacent to each of the upper openings 22 in the outer playing area periphery 18 are a plurality of side drainage scuppers or drainage cutouts 20 defined by the upper surface 38 to allow for water drainage. More particularly, the side drainage scuppers 20 define channels each having a depth which bottom communicates with the surface of the inner playing area 16 to facilitate the rapid drainage of any water. Referring to FIG. 5, the inner playing area 16 starts from the center and radially slopes downwardly for water drainage but is still substantially planar for use as a game surface such as for receiving playing cards and the like. As shown in FIG. 5, by way of example only, this angle of decline 50 may be one degree or more. Additionally it should be understood that the bottoms of the side drainage scuppers 20 also match this angle of decline. The inner playing area 16 and outer playing area periphery 18 are connected and joined by a circumferential ring or wall 52 which may also be used to define the diameter of the inner carpet layer 12.

The floatable base member 46 lends itself to construction from a variety of materials and methods. Preferably, the floatable base member 46 is formed of plastic material using injection molding or other suitable fabrication means. By way of example only and referring to FIGS. 2A and 2B there is shown exploded views of the upper surface 38 positioned over the lower surface 28. Each surface may be formed separately from a thermoplastic sheet such as polypropylene, polyethylene or polyvinyl chloride using a vacuum forming technique. The upper surface 38 is formed with a lower circumferential lip 33 and the lower surface 28 is formed with a plurality of convex sections 32 defining a plurality of upwardly extending triangular recesses 34 and an upper circumferential lip 30. The downwardly extending triangular recesses 34 provide rigidity and structural integrity to the floatable base member 46. In a second step, the two surfaces 38 and 28 respectively, are then thermo welded at the circumferential lips 30 and 33 to form the floatable base member 46 as shown in FIG. 1. The recesses 34 bring that portion of the lower surface 28 in closer proximity to the upper surface 38 to increase the rigidity and structural integrity of the poker pad 48, thereby preventing collapsing or flexing of the upper surface 38.

Figure 6:
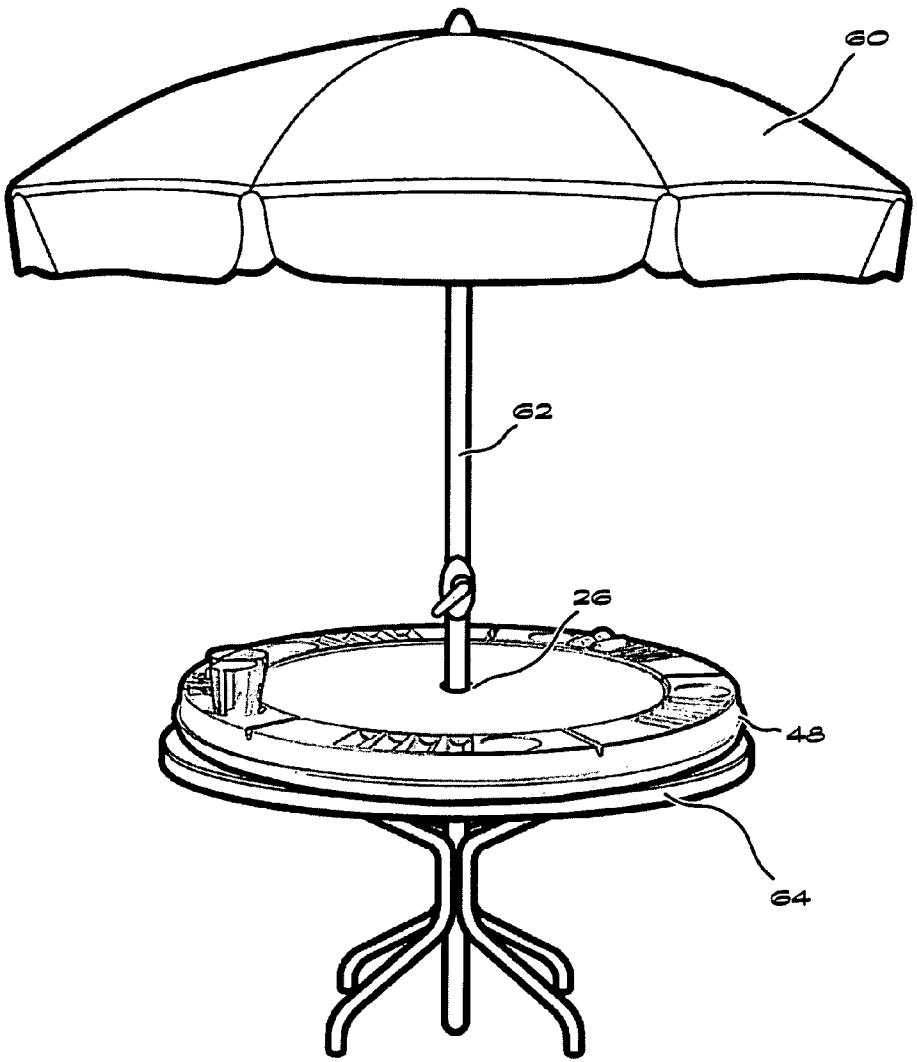
FIG. 6 is a perspective view of a patio table and umbrella assembly with which is shown a floating poker pad according to the present invention.

Preferably, the floatable base member 46 is substantially hollow and may be produced by roto-molding, blow molding, vacuum forming or any other suitable technique with one example described above. Preferably, the floatable base member 46 is substantially circular, as shown in FIG. 1, although the floatable base member 46 may be any shape. Construction of the floatable base member 46 of molded plastic results in a poker pad 48 formed as a single, monolithic unit of only one piece, thus providing for durability and economy of construction and purchase wherein the poker pad 48 floats to allow for use on water. By way of example only and not of limitation the following represents just one set of dimensions for the poker pad 48 described above:

Top half or upper surface 38 of the poker pad 48:
Overall dimensions 38: 39.0" diameter×2¼" high;
play area 16: 29.0" diameter×¾" deep;
chip holders 25: 3.0" radius×4-in long;
cup holders 20: 3.125"×1.5" deep;
drain slots 50: "0.125" radius×4¾" long;
center hole 26: 2.5" diameter×1.5" deep.
Bottom half or lower surface 28 of the poker pad 48:
Overall dimensions 30: 39.0" dia×1¼" deep;
center hole 26: 2.5" dia×1.0" deep; and
triangular access 34: 1.25" deep.
Center plug 14 of the poker pad 48:
Approximate overall dimensions: 1.5" deep×2.5" dia Referring now to FIG. 6, in certain designs of outdoor patio furniture, a table 64 is provided that includes an umbrella 60 having a pole 62 extending through a hole typically in the center of the table 64. Referring once again to FIGS. 2-4, the floatable base member 46 defines a central hole 26 adapted to receive an umbrella pole when placed on a patio table to allow for use on land. Additionally the carpet-type playing area 12 has a same sized and located central hole 44 also adapted to receive the umbrella pole 62. For use on water the two holes are corked using a plug 14 made of a rubber material or the like having a section of the carpet-type playing material 56 affixed to the top for fitting into holes 26 and 44. In use it is necessary to remove the plug 14 and an umbrella pole 60 and place the floatable base member 46 and carpet-type playing area 12 onto a patio table top 64 and then replace the pole and umbrella assembly through the central holes 26 and 44 in the floatable base member 46 and carpet type playing area 12. Therefore a poker pad 48 is provided that is adapted for use upon a surface such as a patio table having an upwardly extending projection such as an umbrella pole.

It should be understood that more or fewer chip rack storage areas and/or sections of those storage areas, upper openings for beverage containers and drainage scuppers, may be provided without departing from the spirit of the present invention While advantageous embodiments have been chosen to illustrate the invention, it will be understood by those skilled in the art that various changes and modifications may be made therein without departing from the scope of the invention as defined in the appended claims.

What is claimed is:

1. A poker pad comprising:

a substantially hollow floatable base member having an upper surface and a lower surface wherein said floatable base member is formed by attaching said upper surface to said lower surface thereby forming said hollow floatable base member;

said upper surface defining a slightly sloped central inner playing area surrounded by a raised circumferential outer playing area periphery;

said playing outer area periphery having a plurality of cutouts defining side drainage scuppers defined by said upper surface to allow for water drainage for use on water; and said floatable base member defining a central hole whereby said central hole is adapted to receive an umbrella pole when said floatable base member is placed on a patio table to allow for use on land.

2. The poker pad according to claim 1, further comprising:

a carpet-type playing surface shaped and sized to be smaller than circumference of said central inner playing area for removable placement down and lifting off of said carpet-type playing surface relative to said central inner playing area.

3. The poker pad according to claim 2, further comprising:

said carpet-type playing surface used for displaying decorative logos and/or indicia wherein said carpet-type playing area has a same sized and located central hole also adapted to receive the umbrella pole.

4. The poker pad according to claim 3, further comprising:

said carpet-type playing area has a same sized and located central hole also adapted to receive the umbrella pole.

5. The poker pad according to claim 4, further comprising:

a plug having a section of said carpet-type playing material affixed to a top wherein said plug is sized and shaped for fitting into said central hole of said floatable base member and said central hole of said carpet-type playing area for corking the poker pad for allowing game play on water.

6. The poker pad according to claim 1, further comprising:

a plurality of generally circumferential concave areas defined within said outer playing area periphery and divided into a plurality of semicircumferential chip rack areas whereby said chip rack areas adapted for edgewise storage of poker chips therein.

7. The poker pad according to claim 6, further comprising:

said chip rack areas being divided into a plurality of adjacent individual chip storage areas each said individual chip storage area having a generally semicircular cross section for closely fitting a circular shape of poker chips whereby the poker chips may be stored therein.

8. The poker pad according to claim 1, further comprising:

said outer playing area periphery having a plurality of upper openings defined by said upper surface wherein said upper openings are adapted to receive beverage containers.

9. The poker pad according to claim 1, further comprising:

said plurality of side drainage scuppers defining channels each having a depth which bottom communicates with said inner playing area surface to facilitate the rapid drainage of water.

10. The poker pad according to claim 9, further comprising:

said inner playing area surface starting from center and radially sloping downwardly for water drainage and still substantially planar for use as a game surface.

11. The poker pad according to claim 10, further comprising:

said inner playing area surface radially sloping downwardly at an angle of decline of one degree wherein said bottoms of said plurality of side drainage scuppers match said angle of decline.

12. The poker pad according to claim 1, further comprising:

said lower surface formed with a plurality of convex sections defining a plurality of downwardly extending recesses wherein said downwardly extending recesses provide rigidity and structural integrity to said floatable base member.

13. The poker pad according to claim 12, further comprising:

said extending recesses bringing said plurality of convex sections of said lower surface in close proximity to said upper surface for increasing rigidity and structural integrity thereby preventing collapsing or flexing of said upper surface.

14. A poker pad comprising:

a substantially hollow floatable base member having an upper surface and a lower surface wherein said floatable base member is formed by wielding said upper surface to said lower surface thereby forming said hollow floatable base member;

said upper surface defining a slightly sloped central inner playing area surrounded by a raised circumferential outer playing area periphery;

said playing outer area periphery having a plurality of cutouts defining side drainage scuppers defined by said upper surface to allow for water drainage for use on water;

a carpet-type playing surface shaped and sized to be smaller than circumference of said central inner playing area for removable placement down and lifting off of said carpet-type playing surface relative to said central inner playing area wherein said floatable base member defining a central hole and said carpet-type playing area defining a similar sized and located central hole wherein both said holes adapted to receive an umbrella pole when said floatable base member and said carpet-type playing area are placed on a patio table that receives the umbrella pole for use on land.

15. The poker pad according to claim 14, further comprising:

a plurality of generally circumferential concave areas defined within said outer playing area periphery and divided into a plurality of semicircumferential chip rack areas whereby said chip rack areas adapted for edgewise storage of poker chips wherein said chip rack areas being divided into a plurality of adjacent individual chip storage areas each said individual chip storage area having a generally semicircular cross section for closely fitting a circular shape of poker chips whereby the poker chips may be stored therein.

16. The poker pad according to claim 14, further comprising:

said outer playing area periphery having a plurality of upper openings defined by said upper surface wherein said upper openings are adapted to receive beverage containers.

17. The poker pad according to claim 14, further comprising:

said plurality of side drainage scuppers defining channels each having a depth which bottom communicates with said inner playing area surface to facilitate the rapid drainage of water wherein said inner playing area surface starting from center and radially sloping downwardly for water drainage and still substantially planar for use as a game surface.

18. A poker pad comprising:

a substantially hollow floatable base member having an upper surface and a lower surface wherein said floatable base member is formed by attaching said upper surface to said lower surface thereby forming said hollow floatable base member;

said upper surface defining a slightly sloped central inner playing area surrounded by a raised circumferential outer playing area periphery;

said playing outer area periphery having a plurality of cutouts defining side drainage scuppers defined by said upper surface to allow for water drainage for use on water;

a carpet-type playing surface shaped and sized to be smaller than circumference of said central inner playing area for removable placement down and lifting off of said carpet-type playing surface relative to said central inner playing area wherein said floatable base member defining a central hole and said carpet-type playing area defining a similar sized and located central hole wherein both said holes adapted to receive an umbrella pole when said floatable base member and said carpet-type playing area are placed on a patio table that receives the umbrella pole for use on land; and a plug having a section of said carpet-type playing material affixed to a top wherein said plug is sized and shaped for fitting into said central hole of said floatable base member and said central hole of said carpet-type playing area for corking the poker pad for allowing game play on water.

* * * * *